US005372102A

United States Patent [19]

Schmid et al.

[11] Patent Number: 5,372,102

[45] Date of Patent: Dec. 13, 1994

[54] PROCESS FOR HEATING THE INTAKE AIR IN INTERNAL-COMBUSTION ENGINES BY MEANS OF A FLAME STARTING SYSTEM

[75] Inventors: Friedrich Schmid, Korb; Andreas Koppitz; Friedrich Hase, both of Stuttgart; Peter Joppig, Korb; Roland Klak, Ostfildern, all of Germany

[73] Assignee: Mercedes-Benz AG, Stuttgart, Germany

[21] Appl. No.: 112,080

[22] Filed: Dec. 23, 1991

[30] Foreign Application Priority Data

Dec. 22, 1990 [DE] Germany ..... 4041630

[51] Int. Cl.[5] ..... F02N 17/047

[52] U.S. Cl. ..... 123/179.21

[58] Field of Search ..... 123/179.21, 179.6, 550, 123/551

[56] References Cited

U.S. PATENT DOCUMENTS 4,624,226 11/1986 Klak et al. ..... 123/179.21
4,934,349 6/1990 Demizu ..... 123/179.21

FOREIGN PATENT DOCUMENTS

3316447A1 12/1983 Germany .
3342865A1 6/1985 Germany .
59-41673 3/1984 Japan ..... 123/179.6
2099920 12/1982 United Kingdom .

OTHER PUBLICATIONS

European Search Report No. 91118286.3—dated Aug. 26, 1993.
Patent Abstracts of Japan, vol. 9, No. 3, (M-349), 9 Jan. 1985 & JP-A-59 153 979 (Nippon Denso KK) 1 Sep. 1984.
Patent Abstracts of Japan, vol. 8, No. 267, (M-343) 7 Dec. 1984 & JP-A-59 138 775 (Toyota Jidosha KK) 9 Aug. 1984.
Patents Abstracts of Japan, vol. 8, No. 120, (M-300) 6 Jun. 1984 & JP-A-59 025 084 (Yanmar Diesel KK) 8 Feb. 1984.

*Primary Examiner*—Andrew M. Dolinar
*Attorney, Agent, or Firm*—Evenson, McKeown, Edwards & Lenahan

[57] ABSTRACT

The invention relates to a process and apparatus for heating the intake air in internal-combustion engines by means of a flame starting system with at least one glow plug. The apparatus is controlled in such a manner that the glow plug is continuously preheated during a first time period and is operated in pulses in a following second time period and the glow plug is switched off after a safety time has elapsed. The glow plug is preheated after it has been switched off, taking into account the instantaneous glow plug temperature during the cooling and the voltage available in such a manner that the temperature required for a repeat start is reached within a narrow tolerance band. In the case of a repeat starting operation taking place after the safety time has elapsed, the renewed preheating time for the glow plug is specified in accordance with a value determined from the glow plug temperature and the available voltage, the instantaneous glow plug temperature being determined from the cooling time of the glow plug after it has been switched off.

21 Claims, 2 Drawing Sheets

| VOLTAGE U IN V | PREHEAT TIME t IN SECONDS IN DEPENDENCE ON THE COOLING INTERVAL | | | | | | | |
|---|---|---|---|---|---|---|---|---|
| | 0-2s | 2-6s | 6-10s | 10-18s | 18-34s | 34-66s | 66-130s | 130-480s |
| 10. | 9 | 13 | 16 | 20 | 25 | 30 | 38 | 45 |
| 10.5 | 7 | 10 | 13 | 17 | 21 | 26 | 32 | 38 |
| 11. | 5 | 8 | 11 | 14 | 18 | 22 | 27 | 32 |
| 11.5 | 4 | 6 | 9 | 12 | 15 | 19 | 23 | 27 |
| 12 | 3 | 5 | 8 | 10 | 13 | 16 | 20 | 23 |
| 12.5 | 3 | 5 | 8 | 10 | 12 | 14 | 18 | 20 |
| 13. | 2 | 4 | 7 | 9 | 11 | 13 | 16 | 18 |
| 13.5 | 2 | 4 | 6 | 8 | 10 | 12 | 15 | 17 |
| 14. | 2 | 3 | 5 | 7 | 9 | 11 | 13 | 15 |

PROCESS FOR HEATING THE INTAKE AIR IN INTERNAL-COMBUSTION ENGINES BY MEANS OF A FLAME STARTING SYSTEM

BACKGROUND AND SUMMARY OF THE INVENTION

The invention relates to a process for heating the intake air in internal-combustion engines by means of a flame starting system having an electrically heatable glow plug.

A process of this type is known from German Patent Document DE-PS 33 42 865, corresponding to U.S. Pat. No. 4,624,266. This process concerns a flame starting system in which the air flowing through the intake pipe is preheated in the warm-up phase of the internal-combustion engine to prevent so-called "white smoke". For this purpose, a combustion chamber is provided in the suction pipe of the internal-combustion engine in which a fuel injection nozzle and a glow plug are arranged. For starting the internal-combustion engine at relatively low temperatures, the glow plug is preheated, and after the conclusion of the preheating time, during the starting of the engine, fuel is delivered via a solenoid valve to the fuel injection nozzle and therefore into the combustion chamber of the flame starting system. The fuel ignited in the combustion chamber preheats the intake air flowing past and permits a reliable ignition of the cylinders of the internal-combustion engine at low outside temperatures. A continuous current is fed to the glow plug for the duration of a specific first period of time, until the engine turns over reliably, and, after the conclusion of this first period of time, a pulsed current corresponding to a reduced power is fed to it until the engine has reached a specific operating temperature.

As soon as the engine is ready to start, a safety period is commenced and is terminated by a successful starting operation. If, however, there is no starting operation or if the engine has stopped again within the safety period and after the starting procedure has been carried out, the current to the glow plug is interrupted for safety reasons and to protect the battery after the safety period has elapsed. The flame starting operation is then terminated and the glow plug cools down.

If a renewed starting operation is to be undertaken, the flame starting system must be switched on again and the glow plug preheated again in a manner corresponding to the procedure described above. This renewed preheating operation, however, does not take into account the instantaneous glow plug temperature, which is determined by the cooling period of the glow plug, nor does it take into account the voltage available at the glow plug.

The invention is therefore based on the object of preheating a glow plug, taking into account the instantaneous glow plug temperature and the voltage applied, in such a manner that the temperature required for a repeat start is reached in a simple manner within a narrow tolerance band.

The object is achieved according to certain preferred embodiments of the invention by means of a process for controlling preheating of a glow plug of a flame starting system for heating intake air in an internal combustion engine comprising determining the glow plug temperature based on the cooling time after the glow plug was previously switched off by subdividing the cooling time into discrete time intervals ($t_0$-$t_1$, $t_1$-$t_2$ - - - $t_7$, $t_8$) which each have an associated preheating time (t)x value, at least some of said discrete time intervals having different durations based on cooling time versus temperature characteristics of the glow plug, and preheating the glow plug for the associated preheating time (t)x value determined for the respective discrete time interval after switch off of the glow plug.

According to preferred embodiments of the invention, there is provided a process for controlling preheating of a glow plug of a flame starting system for heating intake air in internal combustion engines, comprising determining the glow plug temperature based on the cooling time after the glow plug was previously switched off by subdividing the cooling time into discrete time intervals ($t_0$-$t_1$, $t_1$-$t_2$ - - - $t_7$, $t_8$) which each have an associated preheating time (t)x value, preparing a table of preheating times as a function of available voltage and of respective discrete time intervals after switch off of the glow plug, and preheating the glow plug for the associated preheating time from the table.

The invention also contemplates apparatus for carrying out these processes.

After the conclusion of the safety period of a flame starting system and when the engine has not started, the flame starting operation is terminated and the glow plug used in the flame starting system cools down. The instantaneous glow plug temperature is determined by the time measurement, using the cooling curve of the glow plug which has been determined, and the associated preheating time for a repeat start is relayed to the control unit of the flame starting system. If the device is now restarted, each time section of the cooling curve of the glow plug now has its own previously determined value for the preheating time so that the glow plug temperature is always brought to a specifically defined value necessary for the repeat start and located within a permissible range of tolerance.

Other objects, advantages and novel features of the present invention will become apparent from the following detailed description of the invention when considered in conjunction with the accompanying drawings.

DETAILED DESCRIPTION OF THE PREFERRED EMBODIMENTS

Flame starting systems for preheating the intake air in internal-combustion engines contain one or more glow plugs which are supplied with current from the vehicle battery. When the flame starting system is put into operation, the glow plug(s) is (are) continually preheated during a first time period and the engine can be started. After the first time period has elapsed, the flame starting system is supplied with a pulsed current, corresponding to a reduced power, for the duration of a second time period until the engine has reached its operating temperature. The flame starting operation is then terminated by switching off the current to the glow plug. If, however, the engine does not start at all, the flame starting system switches off automatically after a safety time has elapsed, and the glow plug cools down.

Figure 1:
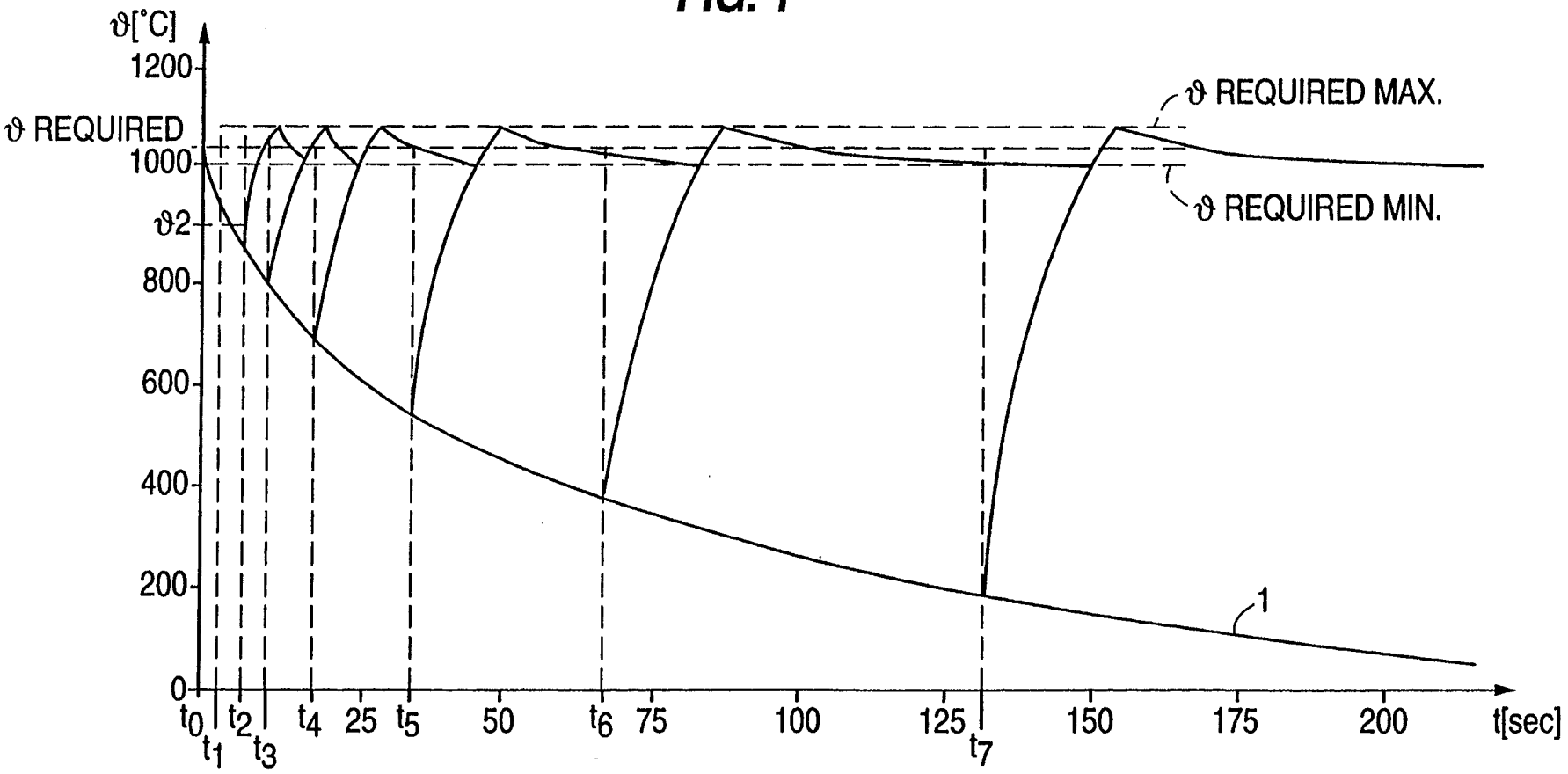
FIG. 1 is a graph of the preheating times for a repeat start according to the process of the invention as a function of the cooling time.

Such a course of the cooling is illustrated in the diagram of FIG. 1. Starting from the required glow plug temperature $v_{required}$, which is approximately 1,050° C. in the diagram, the curve indicated by 1 represents the course of the cooling of a glow plug against the time t in seconds; i.e., the glow plug temperature as a function of time $v(t)$.

If a new attempt to start is made within this cooling time, the glow plug must be preheated for this repeat start as a function of its instantaneous temperature. A measure of the instantaneous glow plug temperature $v$ is provided by the cooling time, which can be determined for each glow plug type employed, such as a rod glow plug or a flame glow plug. This is plotted in FIG. 1 in the form of the cooling curve 1 against time t. When several glow plugs are used in the flame starting system instead of only one, the resulting difference in the cooling and heating action is taken into account by means of different preheating times. Similarly taken into account is the voltage applied to the glow plug; this, of course, plays an important part in the choice of the preheating time. Thus, the preheating time can be correspondingly reduced in the case of a voltage above the required value, whereas the preheating time in the case of a voltage below the required value is increased relative to the normal value; for example, at low temperatures, at which in fact the flame starting system is used.

The preheating time values for a restart, once determined, can be stored in a simple manner in a characteristic field, the control for the flame starting system consisting of an electronic control unit which contains a timer for determining the glow plug cooling time and also includes a characteristic field, stored in a permanent memory, for the corresponding preheating time values as a function of the cooling time, the voltage applied and the type and number of the glow plugs used. The use of a programmable microprocessor is desirable for such an electronic control unit. A characteristic field of the type quoted is, for example, shown in the table of FIG. 2. For the purpose of simplicity, the preheating time values for the repeat start are only given here as a function of the cooling time; i.e., of the instantaneous glow plug temperature after cooling from the required value $v_{required}$. The values which can be taken from the table are only given as examples, without limiting the invention to these values.

As may be easily seen, the number of values to be stored in the characteristics field depends directly on the fineness of the subdivision of the applied voltage and the cooling time value ranges. In order to reduce the number of preheating time values to be stored, the cooling time is divided into individual intervals—into the eight intervals $t_0$-$t_1$, $t_1$-$t_2$, . . . , $t_7$-$t_8$, for example—as shown in FIG. 1. In this case, a particular value for the preheating time is associated with each time interval so that precisely eight different preheating times are also stored for the eight intervals shown here. FIG. 1 shows a preheating for a repeat start for a standard voltage of U=12V, beginning at the time $t_2$; i.e., at the beginning of the third interval (and correspondingly for the following intervals). The procedure described below can, of course, also be applied to the first and second intervals but this is not shown in the figure to make the diagram more easily understood. At the beginning of this interval, the glow plug has a temperature $v_2$ because it has cooled down. This is below the required temperature $v_{required}$ for the glow plug for a repeat start. In this example, the temperature $v_2$ is approximately 900° C. On the basis of this temperature, the glow plug is preheated for a specified preheating time of, in this example, approximately 8 seconds. This preheating time is chosen, on the basis of its instantaneous temperature at the beginning of the interval selected, in such a way that the glow plug temperature does not exceed a specified value $v_{required,\ max}$ after the preheating time has elapsed. The length of the interval $t_2$- $t_3$—approximately 4 seconds in this case—is selected in such a way that for the specified preheating time of 8 seconds in the case of a repeat start at the end of the interval and based on its instantaneous temperature at this time, i.e., directly before the time $t_3$, the glow plug temperature is not less than a second specified value $v_{required,\ min}$. The same applies in an approximate manner to the following intervals. This means that the specified preheating time for the fourth interval beginning at the time $t_3$, which extends as far as the time $t_4$, is again selected in such a way that the temperature does not exceed the upper limit $v_{required,\ max}$ and does not fall below the lower limit $v_{required,min}$. In the case of this fourth interval, this is achieved—in the illustrated example—by means of an interval length of approximately 8 seconds and an associated preheating time of approximately 10 seconds. The result is that for all the repeat start intervals and for the smallest possible number of stored preheating times, the glow plug temperature always lies within a permissible tolerance band between the upper temperature limit $v_{required,\ max}$ and the lower temperature limit $v_{required,\ min}$. These are selected in such a manner that a repeat start is reliably ensured.

As a simplification, the subdivision of the intervals can take place in such a manner that—apart from the first and last intervals—the interval duration is selected in such a manner that each following interval has an interval duration which is approximately twice as large as the duration of the previous intervals. This is not valid for the first and last intervals because the cooling curve there is either extremely steed or extremely flat.

Figures 2, 3:
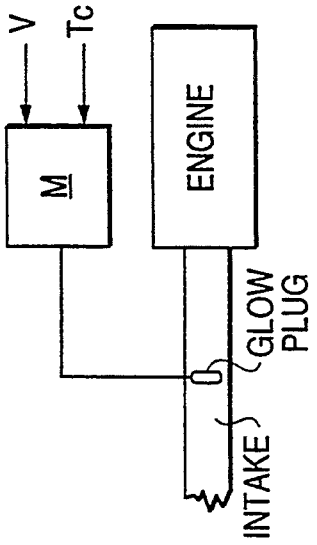
FIG. 2 is a table of the preheating times as a function of the cooling intervals and the applied voltage.
FIG. 3 is a schematic view of apparatus for carrying out the processes of controlling preheating of a glow plug according to the present invention.

The subject matter of what is known from the diagram of FIG. 1 is illustrated in table form in FIG. 2. In this case, the specified preheating times are given as a function of the cooling time t of the glow plug, subdivided into the individual intervals, and as a function of the applied voltage U in volts. On the basis of a standard voltage of U=12V, the preheating times are specified as being greater within each interval with falling voltage and correspondingly smaller with increasing voltage.

FIG. 3 schematically depicts the apparatus for carrying out the above-described processes. A microprocessor M has a stored table corresponding to FIG. 2. Microprocessor M is supplied with schematically shown signal V representing the available battery voltage and signal Tc corresponding to the cooling time since the glow plug was turned off. Microprocessor M controls the reheat time for the glow plug via a control signal based on the detected cool down time To and available voltage V.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A process for controlling preheating of a glow plug of a flame starting system for heating intake air in internal combustion engines, comprising:

determining the glow plug temperature based on the cooling time after the glow plug was previously switched off by subdividing the cooling time into discrete time intervals ($t_0$-$t_1$, $t_1$-$t_2$- - - $t_7$, $t_8$) which each have an associated preheating time (t)x value, at least some of said discrete time intervals having different durations based on cooling time versus temperature characteristics of the glow plug, and preheating the glow plug for the associated preheating time (t)x value determined for the respective discrete time interval after switch off of the glow plug.

2. A process according to claim 1, wherein each interval ($t_0$-$t_1$, $t_1$-$t_2$, . . . , $t_7$-$t_8$) has in increased time duration compared with the previous interval.

3. A process according to claim 2, wherein at least some of said intervals ($t_0$-$t_1$, $t_1$-$t_2$, . . . , $t_7$-$t_8$) has approximately twice the time duration compared with the next previous interval.

4. A process according to claim 1, wherein the value for the preheating time depends on the available voltage (U) for preheating the glow plug.

5. A process according to claim 1, wherein a plurality of glow plugs are provided for an engine, and wherein the value for the preheating time depends on the type and number of the glow plugs.

6. A process according to claim 1, wherein the corresponding values for the preheating time are read from a characteristic field cable based on the available voltage and the time interval after switch off of the glow plug.

7. A process according to claim 1, comprising initially heating the glow plug before switch-off of the glow plug such that the glow plug is continuously preheated during a first time period and is operated in pulses in a following second time period and is then switched off after elapse off a safety time period.

8. A process according to claim 3, comprising initially heating the glow plug before switch-off of the glow plug such that the glow plug is continuously preheated during a first time period and is operated in pulses in a following second time period and is then switched off after elapse of a safety time period.

9. A process according to claim 6, comprising initially heating the glow plug before switch-off of the glow plug such that the glow plug is continuously preheated during a first time period and is operated in pulses in a following second time period and is then switched off after elapse of a safety time period.

10. A process for controlling preheating of a glow plug of a flame starting system for heating intake air in internal combustion engines, comprising:

determining the glow plug temperature based on the cooling time after the glow plug was previously switched off by subdividing the cooling time into discrete time intervals ($t_0$-$t_1$, $t_1$-$t_2$ - - - $t_7$, $t_8$) which each have an associated preheating time (t)x value, preparing a table of preheating times as a function of available voltage and of respective discrete time intervals after switch-off of the glow plug, and preheating the glow plug for the associated preheating time from the table.

11. A process according to claim 10, wherein each interval ($t_0$-$t_1$, $t_1$-$t_2$, . . . , $t_7$-$t_8$) has in increased time duration compared with the previous interval.

12. A process according to claim 11, wherein at least some of said intervals ($t_0$-$t_1$, $t_1$-$t_2$, . . . , $t_7$-$t_8$) has approximately twice the time duration compared with the next previous interval.

13. A process according to claim 10, wherein a plurality of glow plugs are provided for an engine and wherein the value for the preheating time depends on the type and number of the glow plugs.

14. Apparatus for controlling preheating of a glow plug of a flame starting system for heating intake air in internal combustion engines comprising:

a timer for determining the cooling time after the glow plug has been switched off; and a microprocessor for determining the glow plug temperature based on the cooling time after the glow plug was previously switched off by subdividing the cooling time into discrete time intervals ($t_0$-$t_1$, $t_1$-$t_2$, . . . , $t_7$-$t_8$) which each have an associated preheating time (t)x value, at least some of said discrete time intervals having different durations based on cooling time versus temperature characteristics of the glow plug, and preheating means for preheating the glow plug for the associated preheating time (t)x value determined for the respective discrete time interval after switch off of the glow plug.

15. Apparatus according to claim 14, wherein each time interval stored in said microprocessor has an increased time duration compared with the next previous time interval.

16. Apparatus according to claim 15, wherein at least some of said intervals ($t_0$-$t_1$, $t_1$-$t_2$, . . . , $t_7$-$t_8$) has approximately twice the time duration compared with the next previous interval.

17. Apparatus according to claim 16, wherein a plurality of glow plugs are provided for an engine, and wherein the value for the preheating time depends on the type and number of the glow plugs.

18. Apparatus according to claim 14, comprising means for initially heating the glow plug before switch off of the glow plug such that the glow plug is continuously preheated during a first time period and is operated in pulses in a following second time period and is then switched off after elapse of a safety time period.

19. Apparatus for controlling preheating of a glow plug of a flame starting system for heating intake air in internal combustion engines, comprising:

a timer for determining the cooling time after the glow plug has been switched off, and a microprocessor for determining the glow plug temperature based on the cooling time after the glow plug was previously switched off by subdividing the cooling time into discrete time intervals ($t_0$-$t_1$, $t_1$-$t_2$, . . . , $t_7$-$t_8$) which each have an associated preheating time (t)x value, and means for preparing a table of preheating times as a function of available voltage and of respective discrete time intervals after switch-off of the glow plug, and preheating means for preheating the glow plug for the associated preheating time from the table.

20. Apparatus according to claim 19, wherein each time interval stored in said microprocessor has an increased time duration compared with the next previous time interval.

21. Apparatus according to claim 20, wherein at least, some of said intervals ($t_0$-$t_1$, $t_1$-$t_2$, . . . , $t_7$-$t_8$) has approximately twice the time duration compared with the next previous interval.

* * * * *